US008956237B2

(12) United States Patent
Campitelli

(10) Patent No.: US 8,956,237 B2
(45) Date of Patent: Feb. 17, 2015

(54) GOLF SWING TRAINING DEVICE AND METHOD

(71) Applicant: Frank Campitelli, Medina, OH (US)

(72) Inventor: Frank Campitelli, Medina, OH (US)

( * ) Notice: Subject to any disclaimer, the term of this patent is extended or adjusted under 35 U.S.C. 154(b) by 0 days.

(21) Appl. No.: 14/186,860

(22) Filed: Feb. 21, 2014

(65) Prior Publication Data

US 2014/0315652 A1 Oct. 23, 2014

Related U.S. Application Data

(60) Provisional application No. 61/767,680, filed on Feb. 21, 2013.

(51) Int. Cl.

| | |
|---|---|
| ***A63B 69/36*** | (2006.01) |
| ***A63B 23/02*** | (2006.01) |
| ***A63B 21/062*** | (2006.01) |

(52) U.S. Cl.

CPC ..... *A63B 69/3614* (2013.01); *A63B 69/3641* (2013.01)

USPC ..... 473/220

(58) Field of Classification Search

USPC ..... 473/218, 220, 224, 229, 271, 273, 409; 482/92, 93, 99, 103

See application file for complete search history.

(56) References Cited

U.S. PATENT DOCUMENTS

| | | | | |
|---|---|---|---|---|
| 3,604,712 | A | 9/1971 | Prior et al. | |
| 4,261,573 | A | 4/1981 | Richards | |
| 5,050,874 | A | 9/1991 | Fitch | |
| 5,139,264 | A | 8/1992 | Wootten | |
| 5,156,402 | A * | 10/1992 | Hart | 473/229 |
| 5,188,367 | A | 2/1993 | Gipe et al. | |
| 5,242,344 | A * | 9/1993 | Hundley | 482/93 |
| 5,265,876 | A | 11/1993 | Moon | |
| 5,538,251 | A | 7/1996 | Harper | |
| D387,835 | S | 12/1997 | Abram et al. | |
| 6,196,933 | B1 | 3/2001 | Hope et al. | |
| 7,585,228 | B2 | 9/2009 | McFarlin et al. | |
| 7,841,971 | B2 * | 11/2010 | Smith | 482/103 |
| 7,867,102 | B2 * | 1/2011 | Wallace | 473/220 |
| D636,042 | S | 4/2011 | Campitelli | |
| 2002/0111251 | A1 * | 8/2002 | Crump | 482/99 |

* cited by examiner

*Primary Examiner* — Nini Legesse

(74) *Attorney, Agent, or Firm* — QuickPatents; Kevin Prince

(57) ABSTRACT

A golf swing training apparatus includes a base for supporting a person and at least one target path. A pair of risers is fixed with the base, each having a receiver for an arm mechanism that extends up and over the person's head, terminates at a distal end, and pivots between top and bottom positions. The arm mechanism includes a plurality of pulleys fixed thereto around which a cable is positioned. An urging mechanism urges the arm mechanism into the top position. The cable is fixed between the distal end of the arm mechanism and the riser, and includes a shackle at a distal end thereof. A generally cylindrical handle is slidably fixed with and captures the shackle between forward and rear stops. The handle includes a first laser and an opposing second laser for illuminating the target path during practice swings of the handle.

15 Claims, 6 Drawing Sheets

GOLF SWING TRAINING DEVICE AND METHOD

CROSS-REFERENCE TO RELATED APPLICATIONS

This application claims the benefit of U.S. Provisional Patent Application 61/767,680, filed on Feb. 21, 2013, and incorporated herein by reference.

STATEMENT REGARDING FEDERALLY SPONSORED RESEARCH AND DEVELOPMENT

Not Applicable.

FIELD OF THE INVENTION

This invention relates to golf, and more particularly to a golf training apparatus and method.

DISCUSSION OF RELATED ART

Golf training devices are well known in the prior art, and such device for improving a person's swing take several different forms. Many training aids attempt to teach a person how to properly strike a golf ball with a golf club. However, few devices aim to teach a person how to properly swing a golf club, training that is vital and that should be taught first.

Of the swing training products currently available that aim to teach a person how to swing the club, many have no target ball and many such devices do not swing like an actual golf club. Products of this type result in very little inherent feedback for the student. For the most part if the swing is performed slowly the kinesthetic feel of pressure in the hands, proprioception of the body, muscular contraction velocities and force production, and sequential movements are different then when performing a swing at faster, more typical golf club swing speeds. In the same way that standing, crawling, walking, skipping, jogging, running, and sprinting are all different, even though at one instant in time they may appear to be the same, likewise different are golf swings such as putting, chipping, and driving. The lack of inherent or instantaneous feedback in a visual sense when swinging a club is a significant drawback for the prior art golf swing training devices, which typically only provide augmented, after-the-fact feedback based on the ball flight.

Moreover, many training methods include videos of people swinging a club properly, and some methods such as video-recording golf training centers allow a student to compare his swing with that of a professional golfer side-by-slide in slow motion. While this is helpful to a theoretical understanding of what the student may be doing incorrectly, such methods do not impart the kinesthetic or proprioceptive experience of swinging a golf club and striking the ball properly. Indeed, only hitting a golf ball at a practice driving range comes close to providing such a kinesthetic perspective, but such practice fails to help a golfer swing the club and strike the ball accurately except through trial and error. That is to say, an errant hit of a golf ball does not provide much in the way of feedback to the golfer about why the ball was hit incorrectly.

Some prior art swing training devices, such as U.S. Pat. No. 5,188,367 to Gipe et al. on Feb. 23, 1993; U.S. Pat. No. 5,139,264 to Wootten on Aug. 18, 1992; and U.S. Pat. No. 4,261,573 to Richards on Apr. 14, 1981, aim to teach the student by way of inhibiting the student from swinging or positioning the club incorrectly. However, by inhibiting freedom of movement of the club, the kinetic training necessary to correct an errant club position or swing is lacking. As a result, when the student isn't allowed by the mechanism to perform an errant swing, it's more difficult to know that a swing of the club is errant when detached from such a training apparatus.

In my previous design patent, U.S. D636,042, issued on Apr. 12, 2011, I disclosed a prototype version of the present invention that was useful in some ways to overcome the drawbacks of the prior art. However, significant functional improvements have been made since that initial design and such improvements are detailed herein.

Clearly, then, there is a need for a training device that provides instantaneous visual, audio and kinetic feedback during golf club swing training, having inherent directional resistance when swinging the club verses after-the-fact feedback after hitting a ball. Such a needed invention would provide such feedback to the user at all club-swing speeds. Linking visual, audio, and tactile feedback at any club swing speed allows proper progression of the proper swing feel and technique as the golfer goes through successive motor skill stages. The present invention accomplishes these objectives.

SUMMARY OF THE INVENTION

The present device is a golf swing training apparatus that includes a base for supporting a person and at least one target path. A pair of risers is fixed with the base, each having a receiver for receiving a post of an arm mechanism at a facing angle appropriate for either left-handed or right-handed use.

The arm mechanism is pivotally fixed with one of the risers, extends up and over the person's head, and terminates at a distal end. The arm mechanism is adapted to pivot between a top position and a bottom position. A riser frame may be fixed with the base and each riser for laterally supporting each riser in a substantially vertical orientation.

Preferably the arm mechanism includes a plurality of pulleys fixed thereto around which a cable is positioned. A proximal end of the cable is fixed with one of a plurality of arm attachment points through a riser pulley that is fixed with one of a plurality of riser frame attachment points on the riser frame. As such, the distal end of the arm mechanism pivots about a pivot in a swing plane that is tilted at an angle of preferably between 45 and 70 degrees away from vertical.

An urging mechanism is adapted to urge the arm mechanism into the top position. The cable is fixed between the distal end of the arm mechanism and the at least one riser, and includes a shackle at a distal end thereof. The urging mechanism may include a pneumatic cylinder adapted to urge the arm mechanism into its top position. An adjustment mechanism may be included in such an embodiment for adjusting the ratio of the compression of the pneumatic cylinder and the arm mechanism travel distance between the top and bottom positions thereof, resulting in the ability to adjust the resistance that the urging mechanism applies against movement of the cable and, thereby, movement of the arm mechanism.

A generally cylindrical handle is slidably fixed with and captures the shackle of the cable between a forward stop and a rear stop thereof. The handle includes a first laser for projecting a first beam of light out of a forward end of the handle, and a second laser for projecting a second beam of light out of a rear end of the handle.

A method of training the person to swing a golf club may be implemented by providing the golf swing training apparatus as herein described. In use, with the person standing on the base and facing the at least one riser and grasping the handle as though it is a golf club, the person raises the handle into a first backswing position wherein the second laser illuminates the target path. The person then pulls the handle down in a simulated golf club swing to pull the cable which rotates the arm mechanism towards the bottom position and loads the urging mechanism. The handle when inverted at a low point in the swing allows the shackle to move from the forward stop to the rear stop to produce an audible impact noise. The first laser illuminates at this point should be illuminating the target path. The swing process may be repeated at increasing speeds until full speed club swings are achievable while illuminating the target path with both lasers, indicating that the handle is being kept within the swing plane during the swing.

The present invention is a training device that provides instantaneous visual, audio and tactile feedback during golf club swing training. The present apparatus provides inherent, real-time directional resistance when swinging the club verses after-the-fact feedback after hitting a ball, such as observing the ball's trajectory and speed. The present invention provides such real-time feedback to the user at all club-swing speeds, and the linking of visual, audio, and tactile feedback at any club swing speed allows quick progression of the proper swing feel and technique as the golfer goes through successive motor skill stages. Further, the present invention allows is adjustable to golfers of varying sizes and strengths, whether left or right-handed. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
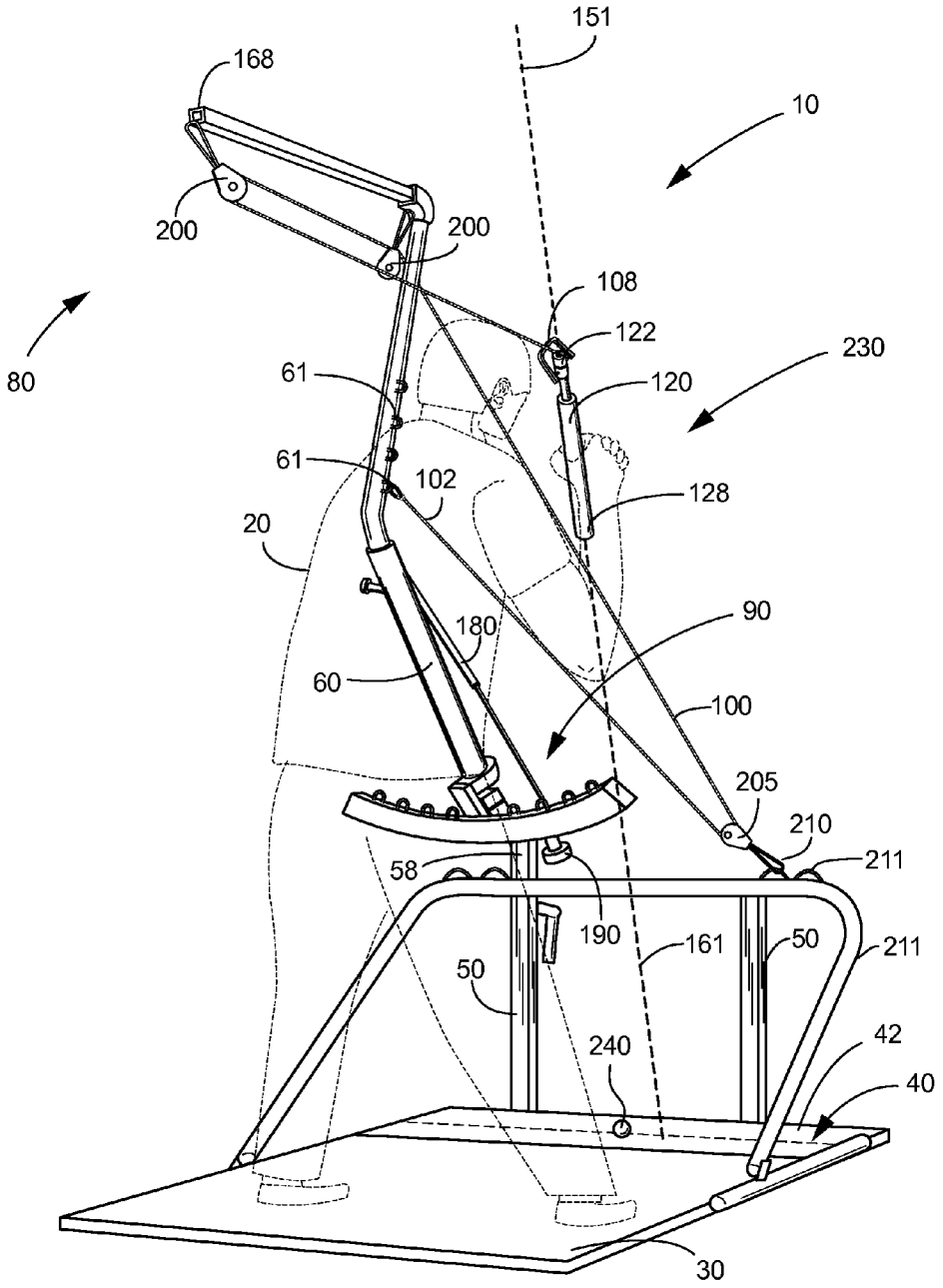
FIG. 1 is a perspective view of the invention, illustrating a person in a first backswing position.
Figure 2:
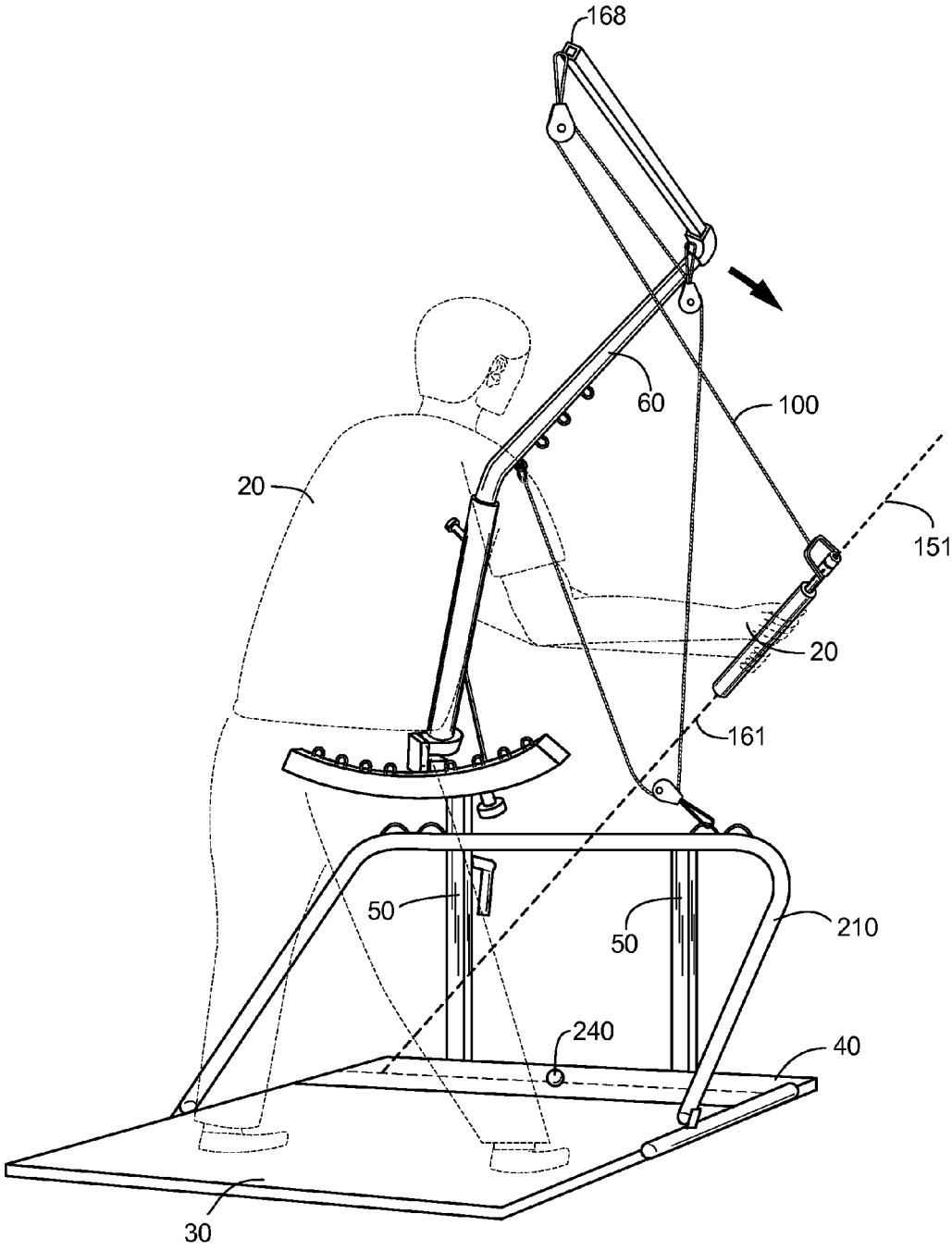
FIG. 2 is a perspective view of the invention, illustrating a person in a second swing position.
Figure 3:
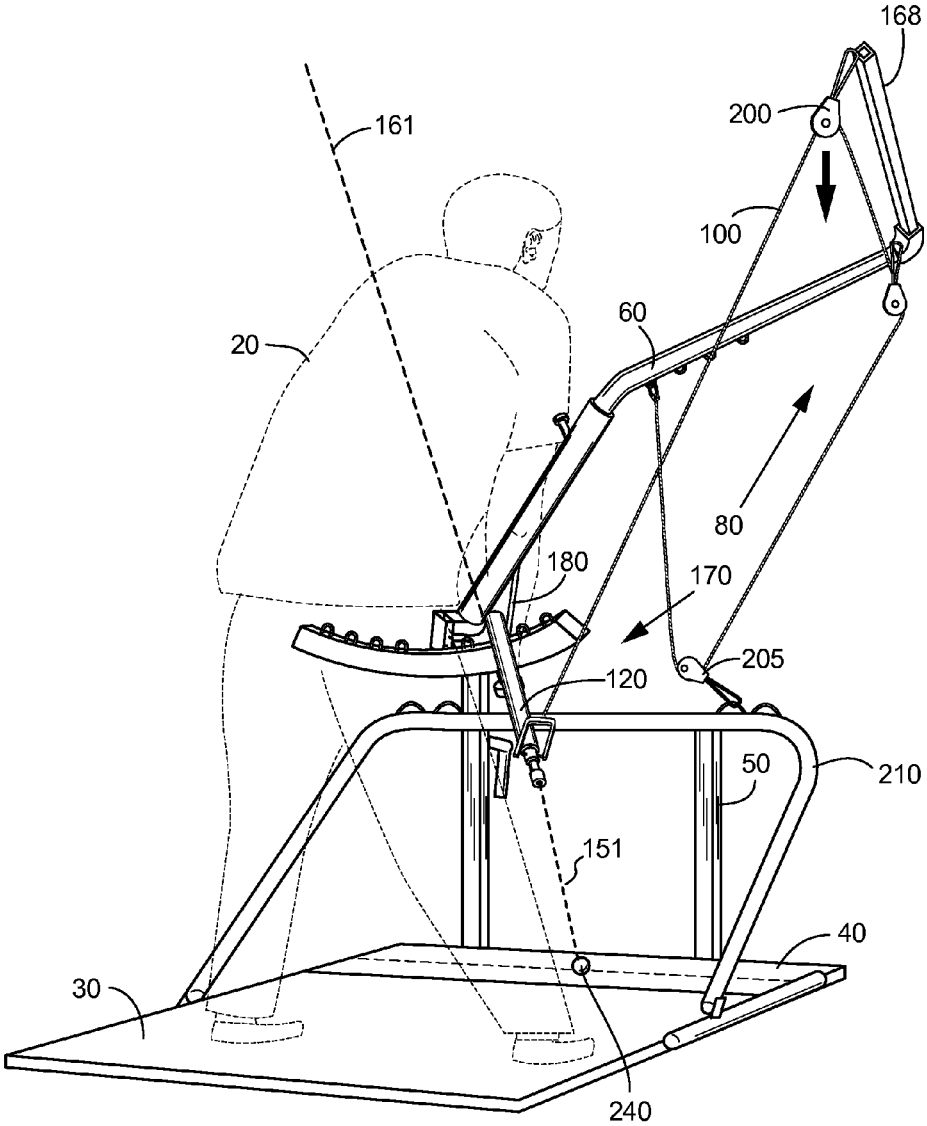
FIG. 3 is a perspective view of the invention, illustrating the person in a ball-striking swing position.

FIGS. 1-3 show a golf swing training apparatus 10 for a person 20 desiring to increase his ability to properly swing a golf club for maximum ball distance and accuracy. Such an apparatus 10 is typically supported on a level horizontal surface, such as a floor of a home or building.

Figure 6:
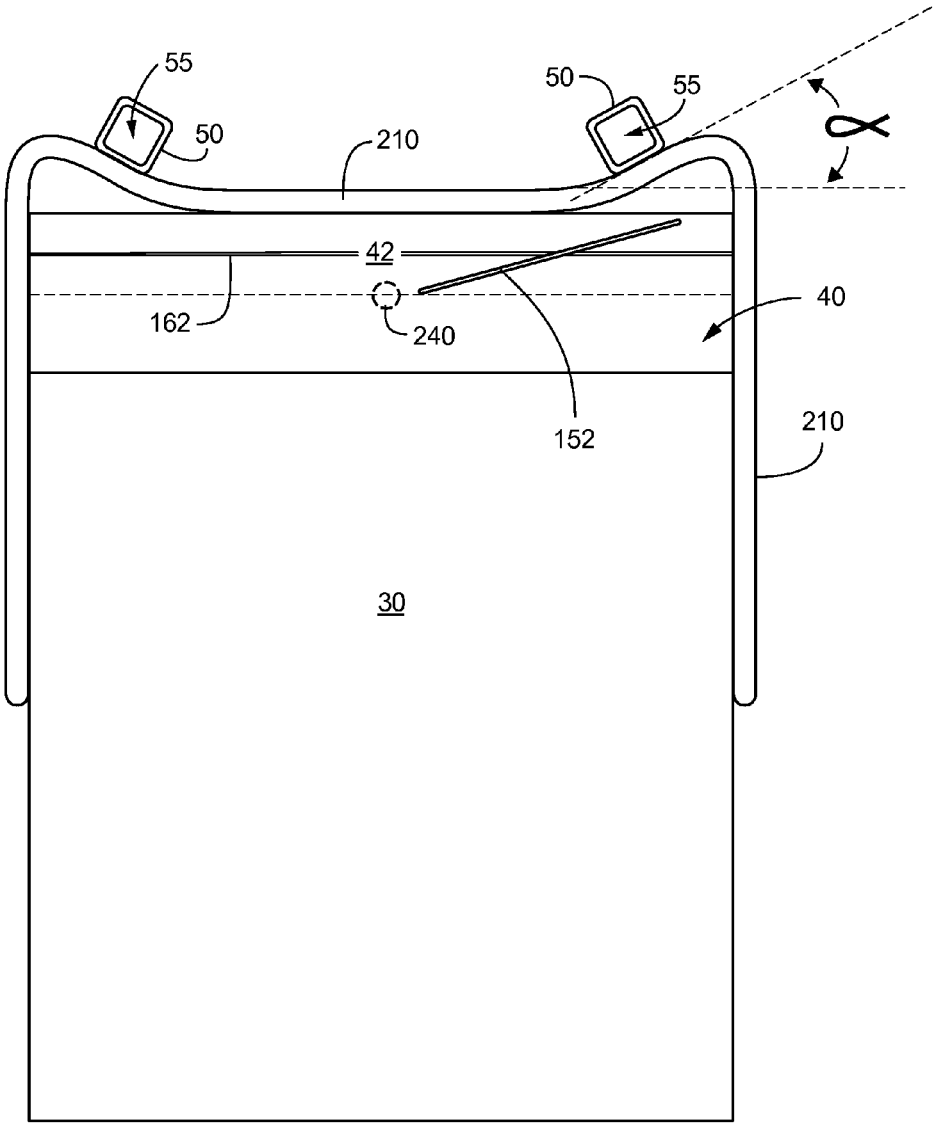
FIG. 6 is a top plan view of the invention, illustrated without an arm mechanism attached for clarity of illustration.

A base 30 for supporting the person 20 on the floor surface (not shown) includes at least one target path 40. At least one riser 50 is fixed with the base 30. Preferably the at least one riser 50 includes two risers 50, each having a receiver 55 for receiving a post 62 of an arm mechanism 60 at a facing angle $\alpha$ (FIG. 6) appropriate for either left-handed or right-handed use. As such, the arm mechanism 60 may be placed into either riser 50 depending on whether the person 20 is right or left-handed. The base 30 may further include a standing surface such as artificial turf (not shown), padding (not shown), or the like, adapted to support the person 20 thereon.

The arm mechanism 60 is pivotally fixed with the at least one riser 50 at one end 58 thereof, and extends up and over the person's head, and terminates at a distal end 68. The arm mechanism 60 is adapted to pivot between a top position 80 (FIG. 1) and a bottom position 70 (FIG. 3). A riser frame 210 may be fixed with the base 30 and each riser 50 for laterally supporting each riser 50 in a substantially vertical orientation. The distal end 68 of the arm mechanism 60 may be telescopically adjustable such that the distal end 68 may be set at a proper distance with respect to the person 20 standing on the base 30. The base 30 and arm mechanism 60 are preferably made from rigid and strong metal materials, such as square metal tube stock welded together, or the like.

Figure 5:
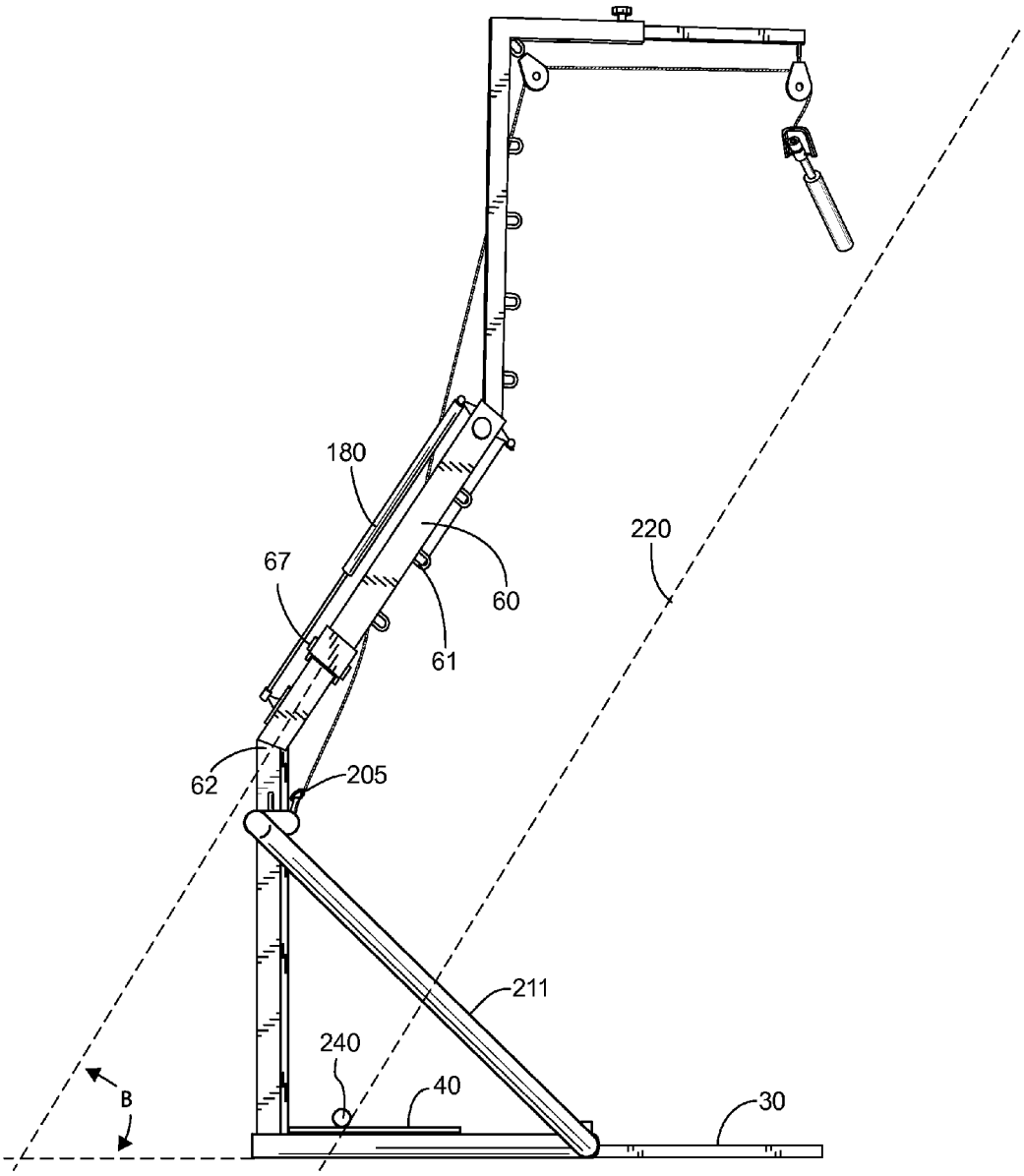
FIG. 5 is a side elevational view of the invention.

Preferably the arm mechanism 60 includes a plurality of pulleys 200 fixed thereto around which a cable 100 is positioned, with a proximal end 102 of the cable 100 fixed with one of a plurality of arm attachment points 61 through a riser pulley 205 that is fixed with one of a plurality of riser frame attachment points 211 on the riser frame 210. As such, the distal end 68 of the arm mechanism 60 pivots about a pivot 67 in a swing plane 220 that is tilted at an angle $\beta$ of preferably between 45 and 70 degrees away from vertical (FIG. 5).

An urging mechanism 90 is adapted to urge the arm mechanism 60 into the top position 80. The cable 100 is fixed between the distal end 68 of the arm mechanism 60 and the at least one riser 50, and includes a shackle 110 at a distal end 108 thereof. The urging mechanism 90 may include a stack of weights (not shown) fixed with a weight cable (not shown), or preferably a pneumatic cylinder 180 adapted to urge the arm mechanism 60 into its top position 80. An adjustment mechanism 190 may be included in such an embodiment for adjusting the ratio of the compression of the pneumatic cylinder 180 and the arm mechanism travel distance between the top and bottom positions 70,80 thereof, resulting in the ability to adjust the resistance that the urging mechanism applies against movement of the cable 100 and, thereby, movement of the arm mechanism 60.

Figure 4A:
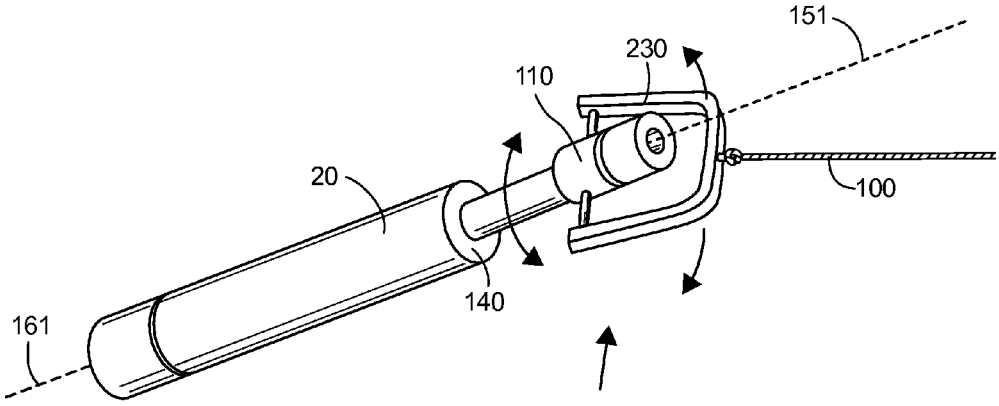
FIG. 4A is a perspective view of a handle of the invention.
Figure 4B:
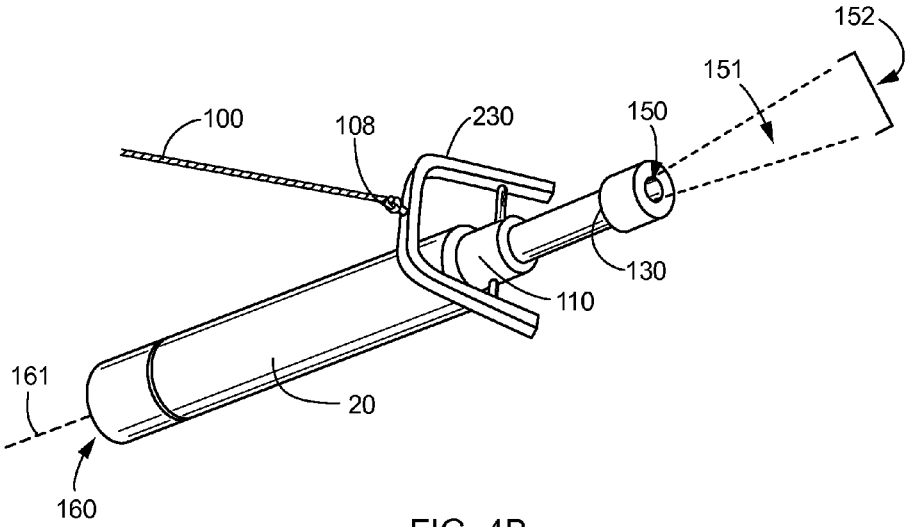
FIG. 4B is a perspective view of the handle in FIG. 3.

A generally cylindrical handle 120 is slidably fixed with and captures the shackle 110 of the cable 100 between a forward stop 130 and a rear stop 140 thereof (FIGS. 4A and 4B). The handle 120 includes a first laser 150 for projecting a first beam 151 of light out of a forward end 128 of the handle 120, and a second laser 160 for projecting a second beam 162 of light out of a rear end 122 of the handle 120.

In use, with the person 20 standing on the base 30 and facing the at least one riser 50 and grasping the handle 120 as though it is a golf club (not shown), the person 20 raises the handle into a first backswing position 230 (FIG. 1) wherein the second laser 160 illuminates the target path 40. The person 20 then pulls the handle 20 down in a simulated golf club swing to pull the cable which rotates the arm mechanism 60 towards the bottom position 70 and loads the urging mechanism 90. The handle 20 when inverted at a low point 170 in the swing (FIG. 3) allows the shackle 110 to move from the forward stop 130 to the rear stop 140 to produce an audible impact noise. The first laser 150 illuminates the target path 40.

In one embodiment the first and second lasers 150,160 are of the same wavelength. Alternately, the first and second lasers 150,160 are of a different wavelength, allowing handle position 20 in the first backswing position 230 (FIG. 1) to be more readily visually distinguished from the handle position 20 at the low point 170 in the swing (FIG. 3). For example, the second laser 160 may be of an ultraviolet wavelength that appears purple vs. a red wavelength of the first laser 150. Preferably in such an embodiment, at least a portion of the target path 40 includes a photoluminescent material 42 that is charged by the ultraviolet second laser 160 and discharges over time. As such, the path of the second laser beam 161 remains illuminated for a period of time after being activated by the second laser 160, providing feedback to the person 20 about his backswing handle position for a longer period of time. Further, while such a path is illuminated, the path of the first laser beam 151 may be readily compared thereto to see how consistently the person 20 kept the handle 20 positioned within the swing plane 220. In one embodiment of the invention, the first laser 150 produces a laser line 152 on the target path 40 indicative of the rotational angle θ of the handle 20.

The shackle 110 of the cable 100 is pivotally fixed with the distal end 108 of the cable 100 with a U-shaped buckle 230 such that the handle 20 may be pivoted in any direction in a hemisphere without the cable 100 contacting the handle 20.

A method of training the person 20 to swing a golf club may be implemented by providing the golf swing training apparatus 10 as herein described. A person 20 is then instructed to stand on the base 30 facing the at least one riser 50. If the person 20 is right-handed, the arm mechanism 60 is placed into the left riser receiver 55 and is converted for right-handed use wherein the distal end 68 of the arm mechanism 60 in the bottom position 70 is to the right of the distal end 68 of the arm mechanism 60 in the top position 80, as illustrated. For left-handed use the urging means 90 is switched to an opposing side of the arm mechanism 60 and the arm mechanism 60 is placed in the right riser receiver 55, such that the distal end 68 of the arm mechanism 60 in the bottom position 70 is to the left of the distal end 68 of the arm mechanism 60 in the top position 80 (not shown).

The cable 100 is then adjusted by clipping or otherwise fastening the proximal end 102 thereof to an appropriate arm attachment point 61 of the arm mechanism 60. Further, the riser pulley 205 is fixed with an appropriate one of the riser frame attachment points 211, such that when the person 20 is at the low point 170 in his swing, the cable 100 has pulled the arm mechanism 60 substantially from the top position 80 to the bottom position 70. Then the adjustment mechanism 190 of the urging mechanism 90 is adjusted to provide a suitable level of resistance to the person 20 as he swings the handle 20 from the first backswing position 230 (FIG. 1) to the low point 170 (FIG. 3).

The person is then instructed to grasp the handle 20 as though it is a golf club, and with the arm mechanism 60 in the top position 80, the person 20 is then instructed to illuminate the target path 40 with the second laser with the handle 20 in the first backswing position 230 (FIG. 1). The person 20 is then instructed to pull the handle 20 down towards the target path 40 in a simulated golf club swing, preferably keeping the handle 20 within the swing plane 220, to pull the cable 100 to rotate the arm mechanism 60 towards the bottom position 70. As such, the cable 100 pulls against the resistance or force of the urging mechanism 90.

The person 20 is then instructed to invert the handle 20 at the low point 170 in the swing as though striking a golf ball with the simulated golf club at a target ball position 240 on the target path 40. This cause the shackle 110 to move from the forward stop 130 on the handle 20 to the rear stop 140 to produce an audible impact noise, and to cause the first laser 150 to traverse the target ball position 240.

The person 20 is then instructed to repeat such a practice swing, slowly at first, moving between the first backswing position 230 all the way through the low point 170 in the swing, to cause the first and second laser beams 151,161 to repeatedly traverse the target ball position 240 accurately and to cause the audible impact noise of the shackle to coincide with the first laser beam 151 illuminating the target ball position 240. The person 20 is then instructed to repeat this process at increasingly faster speeds until a speed of a standard golf swing is achieved while accurately traversing the target ball position 240 with the first and second laser beams 151,161, indicating that the handle 20 is being kept within the swing plane 220 throughout the swing.

In the embodiment wherein the first laser 150 produces a laser line 152 instead of just a beam of light 151, the person 20 may be further instructed to rotate his hands during the swing such that the laser line 152 is aligned with the direction of its travel as it traverses the target ball position 240. This indicates that the person's hands are not rotating the handle 20 through the swing, which would represent a golf club head being "open" or "closed" upon striking the ball and would result in a hook or slice, for example.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A golf swing training apparatus for a person comprising:

a base for supporting the person thereon and including at least one target path;

at least one riser fixed with the base;

an arm mechanism pivotally fixed with the at least one riser at one end thereof and extending up and over the person's head and terminating at a distal end, the arm mechanism adapted to pivot between a bottom position and a top position;

an urging mechanism adapted to urge the arm mechanism into the top position;

a cable fixed between the distal end of the arm mechanism and the at least one riser and including a shackle at a distal end thereof;

a generally cylindrical handle slidably fixed with and capturing the shackle of the cable between a forward stop and a rear stop thereof, the handle including a first laser for projecting a first beam of light out of a forward end of the handle and a second laser for projecting a second beam of light out of a rear end of the handle;

whereby with the person standing on the base facing the riser and grasping the handle as though it is a golf club, the second laser illuminating the target path, the person may pull the handle down in a simulated golf club swing to pull the cable which rotates the arm mechanism towards the bottom position and loads the urging mechanism, the handle when inverted at a low point in the swing allowing the shackle to move from the forward stop to the rear stop and produce an audible impact noise, the first laser illuminating the target path.

2. The golf swing training apparatus of claim 1 wherein the first and second laser beams are of the same wavelength.

3. The golf swing training apparatus of claim 1 wherein the first and second laser beams are of differing wavelengths.

4. The golf swing training apparatus of claim 3 wherein the second beam of light is an ultraviolet wavelength and further including a photoluminescent material on at least a portion of the target path.

5. The golf swing training apparatus of claim 3 wherein the first laser produces a laser line on the target path indicative of rotational angle of the handle.

6. The golf swing training apparatus of claim 1 wherein the urging mechanism includes a pneumatic cylinder.

7. The golf swing training apparatus of claim 6 wherein the urging mechanism includes an adjustment mechanism for adjusting the ratio of the compression of the pneumatic cylinder and the arm mechanism travel distance between the top and bottom positions thereof.

8. The golf swing training apparatus of claim 1 wherein the at least one riser includes two risers, each having a receiver for receiving a post of the arm mechanism at a facing angle appropriate for either left-handed or right-handed use.

9. The golf swing training apparatus of claim 8 further including a riser frame fixed with the base and each riser for laterally supporting each riser.

10. The golf swing training apparatus of claim 9 wherein the arm mechanism includes a plurality of pulleys around which the cable is positioned, and wherein a proximal end of the cable is fixed with one of a plurality of arm attachment points through a riser pulley fixed with one of a plurality of riser frame attachment points.

11. The golf swing training apparatus of claim 10 wherein the distal end of the arm mechanism pivots in a swing plane tilted at an angle of between 45 and 70 degrees away from vertical.

12. The golf swing training apparatus of claim 11 wherein the shackle of the cable is pivotally fixed with the distal end of the cable with a U-shaped bracket such that the handle may be pivoted in any direction in a hemisphere without the cable contacting the handle.

13. A method of training a person to swing a golf club, comprising the steps:

a) providing a golf swing training apparatus that comprises a base for supporting the person and including at least one target path; at least one riser fixed with the base; an arm mechanism pivotally fixed with the at least one riser at one end thereof and extending up and over the person's head and terminating at a distal end, the arm mechanism adapted to pivot between a bottom position and a top position; an urging mechanism adapted to urge the arm mechanism into an upright position; a cable fixed between the distal end of the arm mechanism and the at least one riser and including a shackle at a distal end thereof; and a generally cylindrical handle slidably fixed with and capturing the shackle of the cable between a forward stop and a rear stop thereof, the handle including a first laser for projecting a first beam of light out of the forward end of the handle and a second laser for projecting a second beam of light out of the rear end of the handle;

b) while the person stands on the base facing the riser and grasping the handle as though it is a golf club, and with the arm mechanism in the top position, instructing the person to illuminate the target path with the second laser with the handle in a first backswing position;

c) instructing the person to pull the handle down towards the target path in a simulated golf club swing to pull the cable to rotate the arm mechanism towards the bottom position, the cable pulling against the force of the urging mechanism;

d) instructing the person to invert the handle at a low point in the swing as though striking a golf ball with the simulated golf club at a target ball position on the target path, causing the shackle to move from the forward stop to the rear stop with an audible impact noise, and to cause the first laser to traverse the target ball position;

e) instructing the person to repeat steps b) through d) slowly until he can cause the first and second laser beams to repeatedly traverse the target ball position accurately and cause the audible impact noise of the shackle to coincide with first laser beam illuminating the target ball position;

f) instructing the person to repeat step e) at increasingly faster speeds until a speed of a standard golf swing is achieved.

14. The method of claim 13 further including the step a') providing the first laser that produces a laser line on the target path indicative of rotational position of the handle; and the step e') instructing the person to rotate his hands during the swing such that the laser line is aligned with the direction of the first laser beam as it traverses the target ball position.

15. The method of claim 13 further including the step a") providing a plurality of pulleys on the arm mechanism around which the cable is positioned, fixing a proximal end of the cable with one of a plurality of arm attachment points through a riser pulley fixed with one of a plurality of riser frame attachment points, such that when the person holds the handle such that the first laser is illuminating the target ball position the cable has pulled the arm mechanism substantially towards the lower position.

* * * * *